US006701904B2

(12) United States Patent
Lepley

(10) Patent No.: US 6,701,904 B2
(45) Date of Patent: Mar. 9, 2004

(54) CAPACITIVE DISCHARGE IGNITION SYSTEM WITH EXTENDED DURATION SPARK

(75) Inventor: Joseph M. Lepley, Girard, OH (US)

(73) Assignee: Altronic, Inc., Girard, OH (US)

( * ) Notice: Subject to any disclaimer, the term of this patent is extended or adjusted under 35 U.S.C. 154(b) by 100 days.

(21) Appl. No.: 10/127,244

(22) Filed: Apr. 22, 2002

(65) Prior Publication Data

US 2002/0170547 A1 Nov. 21, 2002

Related U.S. Application Data

(60) Provisional application No. 60/291,808, filed on May 17, 2001.

(51) Int. Cl.[7] ..... F02P 3/06
(52) U.S. Cl. ..... 123/604; 123/605; 123/620
(58) Field of Search ..... 123/604, 605, 123/620

(56) References Cited

U.S. PATENT DOCUMENTS

| | | | |
|---|---|---|---|
| 3,837,326 A | 9/1974 | Kamiji | |
| 3,893,438 A | 7/1975 | Diener | |
| 3,973,544 A | 8/1976 | Suda | |
| 4,149,508 A | 4/1979 | Kirk, Jr. et al. | |
| 4,223,656 A | 9/1980 | Hamley | |
| 4,228,778 A | 10/1980 | Rabus et al. | |
| 4,964,377 A | 10/1990 | Scarnera | |
| 5,220,901 A | 6/1993 | Morita et al. | |

FOREIGN PATENT DOCUMENTS

GB 2043166 A * 10/1980 ..... F02P/3/08

* cited by examiner

*Primary Examiner*—Tony M. Argenbright
*Assistant Examiner*—Hyder Ali
(74) *Attorney, Agent, or Firm*—Webb Ziesenheim Logsdon Orkin & Hanson, P.C.

(57) ABSTRACT

A capacitive discharge ignition system for an internal combustion engine comprises a converter transformer, an ignition transformer, a first triggerable switch S1, the primary winding of the ignition transformer and the storage capacitor being connected in series through the triggerable switch, a spark plug connected in series with the secondary winding of the ignition transformer, a source of direct current and a second triggerable switch S2 connected in series the primary of the converter transformer, and a circuit to control the first and second triggerable switches in synchronism with the engine.

5 Claims, 9 Drawing Sheets

CAPACITIVE DISCHARGE IGNITION SYSTEM WITH EXTENDED DURATION SPARK

CROSS REFERENCE TO RELATED APPLICATION

This application claims priority to U.S. Provisional Patent Application Serial No. 60/291,808, filed May 17, 2001.

BACKGROUND OF THE INVENTION

It is an object, according to the present invention, to provide a capacitive discharge ignition system capable of generating an arc discharge between the spark plug electrodes with a duration three to six times longer than typical for the type of ignition coil in use.

It is a further object, according to the present invention, to be able to adjustably and selectively modify or disable the extended duration spark to obtain the best possible spark plug life.

When engine operation conditions require spark durations previously unavailable from capacitive discharge ignitions, the extended spark can be enabled. This allows the use of a capacitive spark ignition system where inductive-type ignition systems were the only practical choice.

SUMMARY OF THE INVENTION

Briefly, according to the present invention, there is provided a capacitive discharge (CD) ignition system for an internal combustion engine. The ignition system comprises a storage capacitor and diode in series therewith, a converter transformer having primary and secondary windings, the secondary winding thereof connected in series with the storage capacitor and diode, an ignition transformer having primary and secondary windings, a first triggerable switch, the primary winding of the ignition transformer and the storage capacitor being connected in series through the first triggerable switch, a spark plug connected in series with the secondary winding of the ignition transformer, a source of direct current, and a second triggerable switch connected in series with the primary of the converter transformer. A circuit is provided to control the first and second triggerable switches in synchronism with the engine such that while the first switch is open, the second switch is closed for a period to store energy in the converter transformer and then opened to transfer energy to the storage capacitor followed by again closing of the second switch. The first switch is closed to discharge the storage capacitor to the primary of the ignition coil. The second switch is reopened to transfer energy stored in the converter transformer to the primary of the ignition transformer to prolong the current in the secondary of the ignition transformer. The number of times N the second switch is reopened and closed and the time period T for which the second switch remains closed is controlled to control the duration and amplitude of the extended arc current.

BRIEF DESCRIPTION OF THE DRAWINGS

Further features and other objects and advantages will become clear from the following detailed description made with reference to the drawings in which.

DESCRIPTION OF THE PREFERRED EMBODIMENTS

Figure 1:
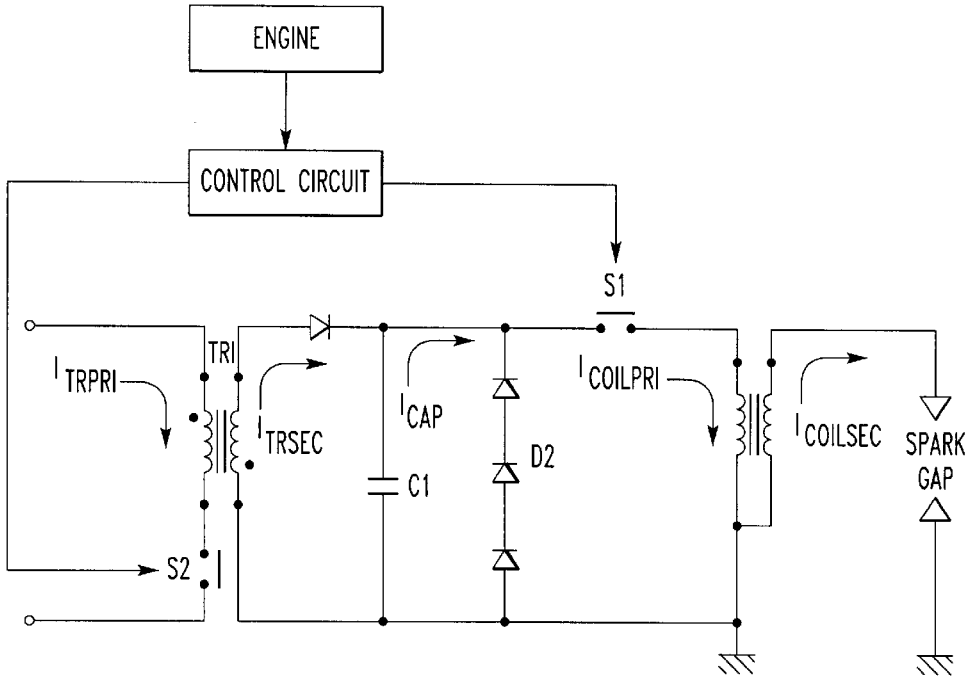
FIG. 1 is a schematic of the circuit configuration according to the present invention.

Referring now to FIG. 1, a transformer TR1 has a primary winding and a secondary winding. The primary winding of the first transformer TR1 is connected to a source of DC voltage, e.g., a battery, via a switch S2. A storage capacitor C1 is positioned in parallel with the secondary winding of transformer TR1. A diode D1 is positioned between the secondary winding of the transformer TR1 and the storage capacitor C1. The diode D1 is oriented to block charging of capacitor C1 with charging current $-I_{TRSEC}$ from the secondary winding when the switch S2 is closed and primary current $I_{TRPRI}$ flows from the battery through the primary winding of the transformer TR1. A plurality of series connected diodes D2 is connected in parallel with storage capacitor C1. The diodes D2 are oriented to block a current $I_{CAP}$ from storage capacitor C1 from flowing therethrough. Connected in parallel with diodes D2 is a primary side of an ignition coil. Connected between the primary side of the ignition coil and the diodes D2 is a switch S1. The ignition coil has a secondary side connected to a spark gap, preferably the gap of a spark plug.

When switch S1 opens, i.e., prior to an ignition event, the switch S2 is closed and primary current $I_{TRPRI}$ is allowed to flow into the primary winding of the transformer TR1. The phasing of the windings of the transformer TR1 is selected so that diode D1 blocks secondary current $-I_{TRSEC}$ from flowing through the secondary winding of the first transformer TR1. When sufficient energy is stored in the primary of the first transformer TR1, switch S2 is opened and energy from the collapsing magnetic field across the secondary winding of the first transformer TR1 causes secondary current $I_{TRSEC}$ to flow through diode D1 and charge storage capacitor C1.

When it is time to provide a spark, switch S1 is closed and the voltage across storage capacitor C1 is impressed across the primary side of the ignition coil. After a delay due to coil inductance, current $I_{CAP}$ begins to flow through the primary side of the ignition coil. The voltage impressed across the primary side of the ignition coil causes a voltage to develop on the secondary side of the ignition coil proportional to the turns ratio of the ignition coil. When the secondary voltage increases to a value sufficient to cause a spark discharge across the spark gap, coil secondary current $I_{COILSEC}$ begins to flow. While the ignition coil secondary current is flowing, the switch S2 is closed and current $I_{TRPRI}$ flows through the primary of the first transformer TR1. The ignition coil secondary current $I_{COILSEC}$ decreases with decreasing current $I_{CAP}$ from storage capacitor C1.

At an appropriate time before the secondary current has decreased sufficiently to extinguish the spark discharge across the spark gap, the switch S2 is opened and transformer TR1 secondary current $I_{TRSEC}$ is developed which flows through the ignition coil primary. Hence, at this time, the current through the ignition coil primary $I_{COILPRI}$ is the sum of the transformer TR1 secondary current $I_{TRSEC}$ and the current $I_{CAP}$ from the storage capacitor C1. The addition at the appropriate time of the secondary current $I_{TRSEC}$ from the secondary coil of the transformer TR1 enables the duration of the spark discharge across the spark gap to be extended. Moreover, the inductance of the secondary coil of the transformer TR1 is connected in series with the inductance of the primary coil of the ignition coil. Hence, the inductance of the circuit supplying the current $I_{COILPRI}$ in the primary side of the ignition coil increases with the addition of current $I_{TRSEC}$ from the secondary winding of the first transformer TR1. This increase in inductance in combination with the secondary current $I_{TRSEC}$ provided by the transformer TR1 increases the arc duration in excess of the sum of the capacitor current $I_{CAP}$ or the secondary current $I_{TRSEC}$ of the transformer TR1 alone.

The switch S2 can be opened and closed a number of times N to prolong the spark current as shown in FIGS. 4–9.

Figure 2:
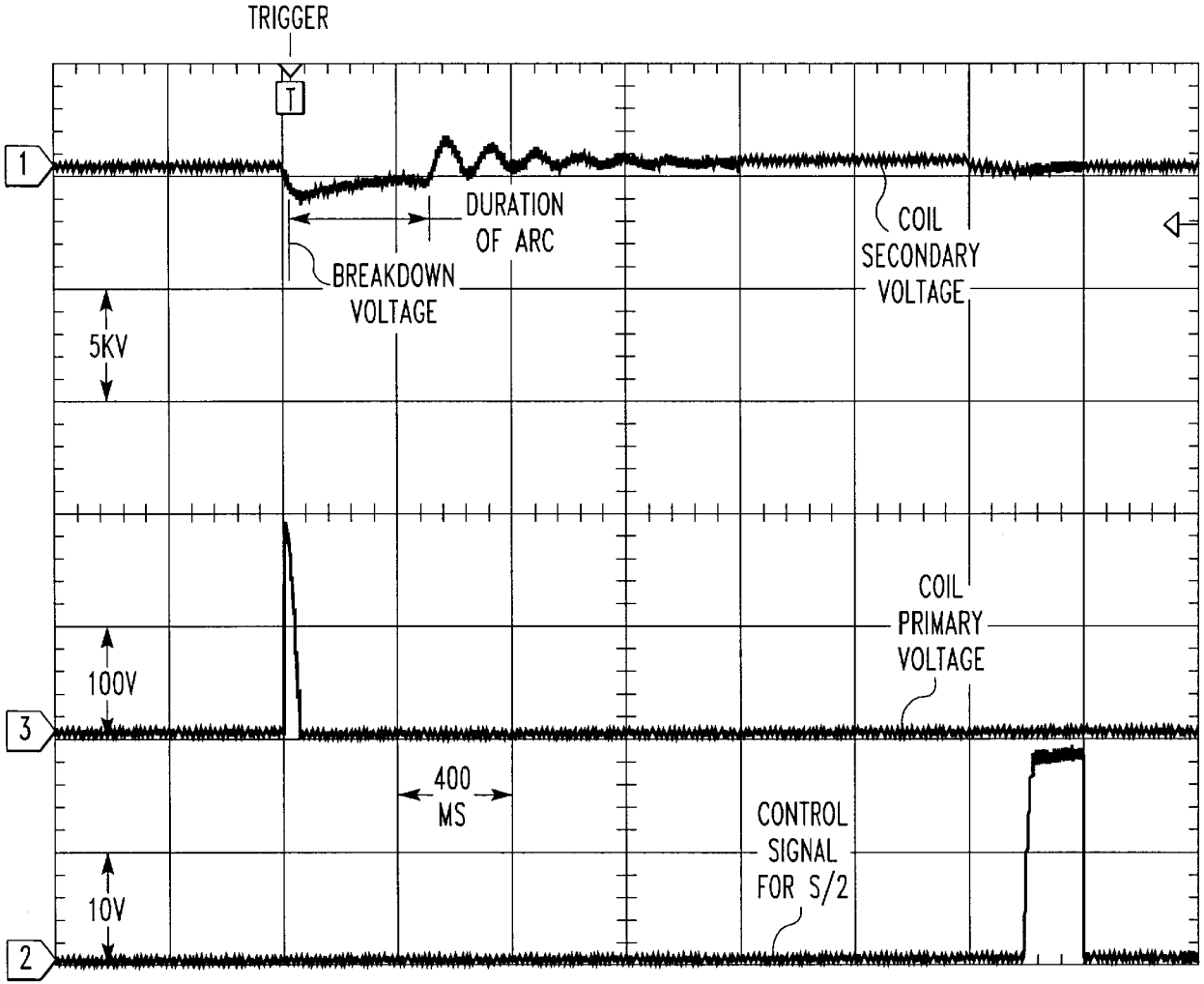
FIG. 2 PRIOR ART
FIG. 2 shows standard capacitive discharge circuit waveforms at 4 kV breakdown voltage providing a 500 microsecond spark.

FIG. 2 illustrates the operation of the circuit according to the prior art. Assume the capacitor C1 has been charged, switches S1 and S2 are both open (non-conducting). In response to a trigger pulse, switch S1 is closed (conducting). This results in a rush of current from the capacitor C1 to the primary of the ignition transformer. The spike in voltage across the primary of about 180 volts is illustrated by the middle trace of FIG. 2. This is reflected in the voltage spike to cause breakdown in the spark gap illustrated in the top trace of FIG. 2. The breakdown voltage in the coil secondary in this instance is approximately 4 kV. The spark duration is approximately 500 microseconds. The bottom trace illustrates the control signal applied to the switch S2 to close the switch to permit recharging of capacitor C1. It should be understood that switch S1 had previously been opened.

Figure 3:
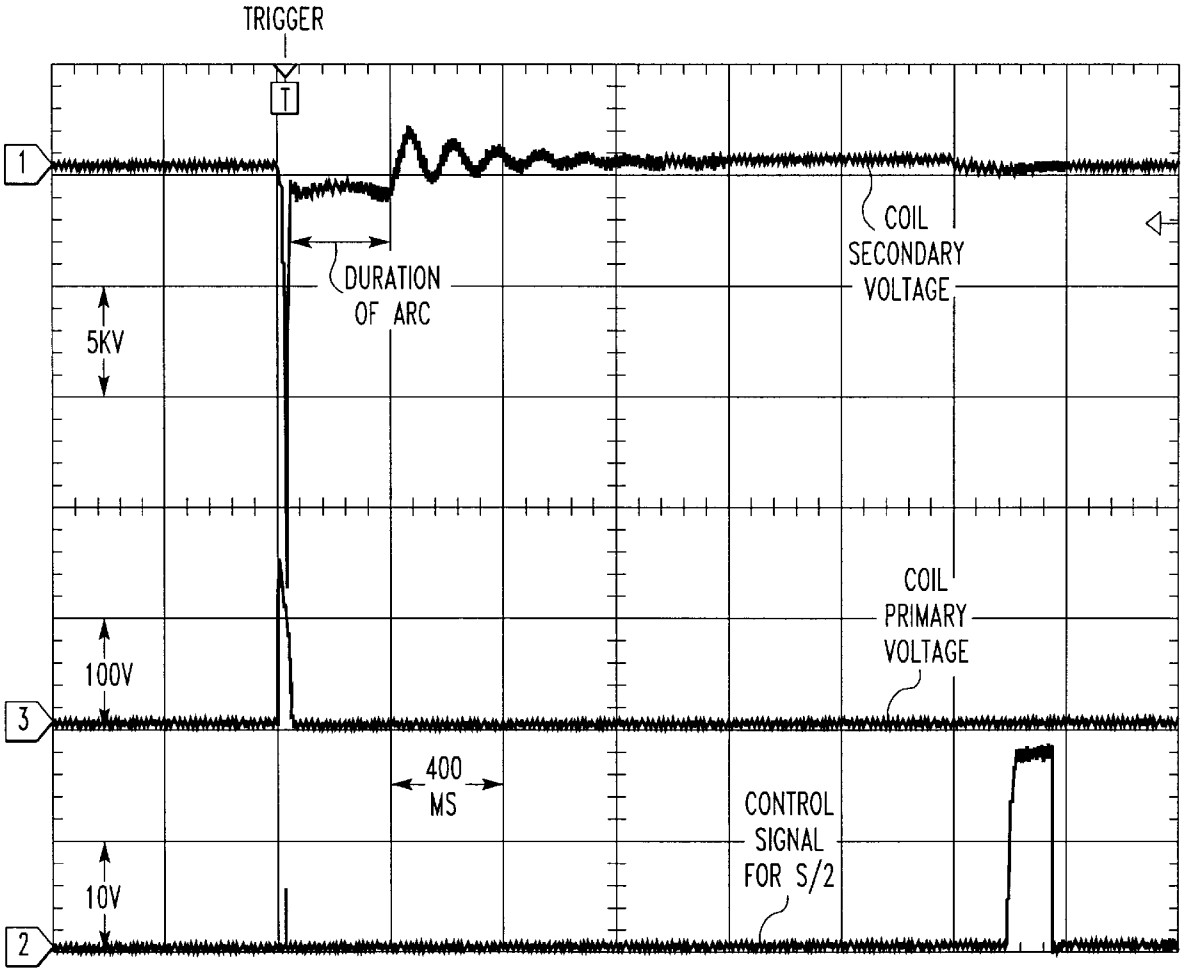
FIG. 3 PRIOR ART
FIG. 3 shows standard capacitive discharge circuit waveforms at 19 kV breakdown voltage providing a 380 microsecond spark.

FIG. 3 is similar to FIG. 2 except for a different spark gap condition, wherein the breakdown voltage across the secondary of the ignition coil is approximately 19 kV. This results in a spark of reduced duration of 380 microseconds. Hence, according to the prior art, the spark duration is related to the breakdown voltage which is a characteristic of the spark gap condition.

Figure 4:
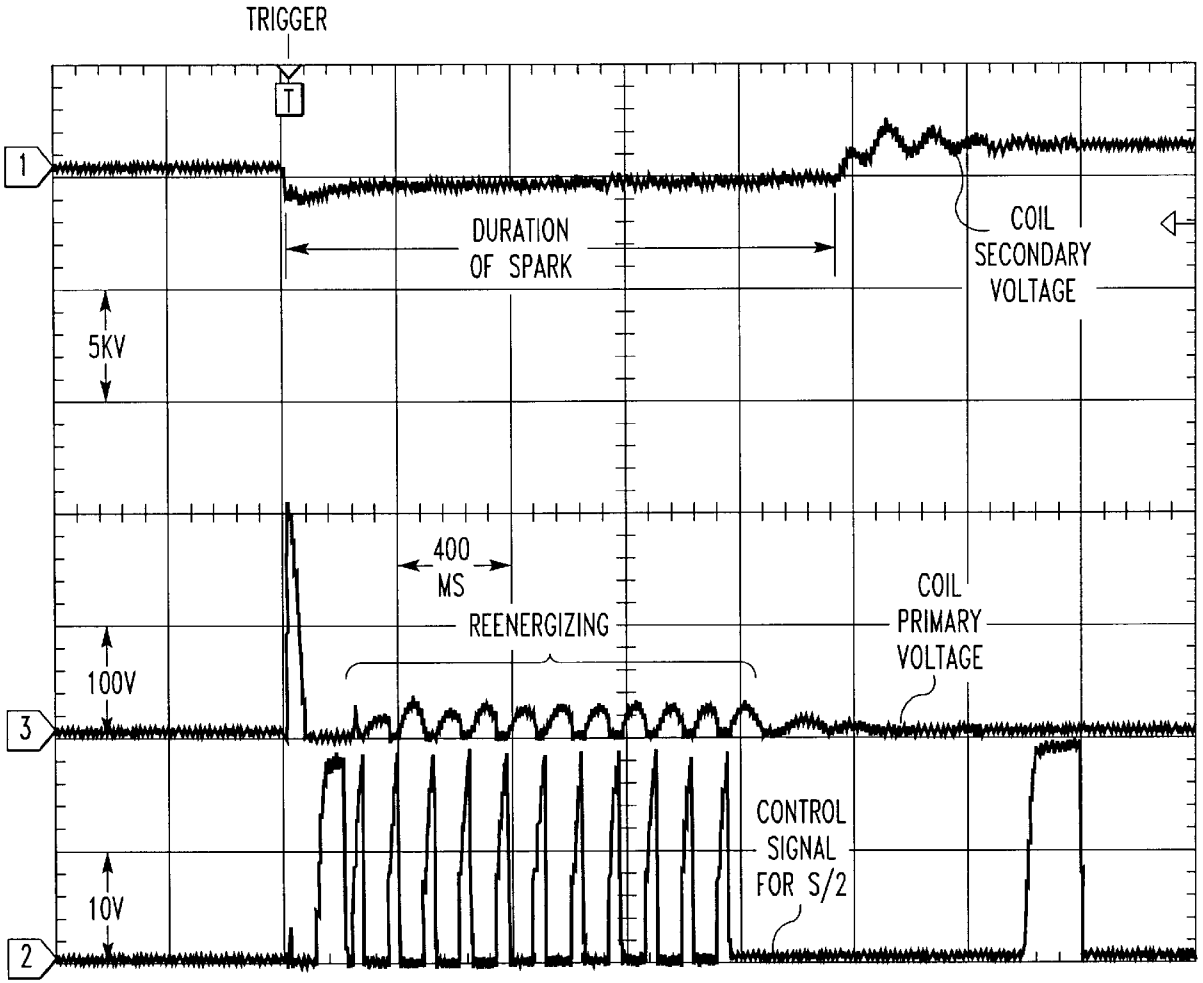
FIG. 4 shows extended capacitive discharge circuit waveforms, according to the present invention, at 5 kV breakdown voltage providing a 1,920 microsecond spark.

FIG. 4 illustrates the operation of a circuit according to the present invention. After the initial closing of switch S1 and following breakdown in the spark gap, the switch S2 is repeatedly opened and closed as illustrated in the bottom trace of FIG. 4. In this instance, the switch is opened and closed twelve (12) times over a period of 1,520 microseconds. This causes the primary of the ignition coil to be reenergized as many times and the duration of the spark to be extended to 1,920 microseconds.

Figure 5:
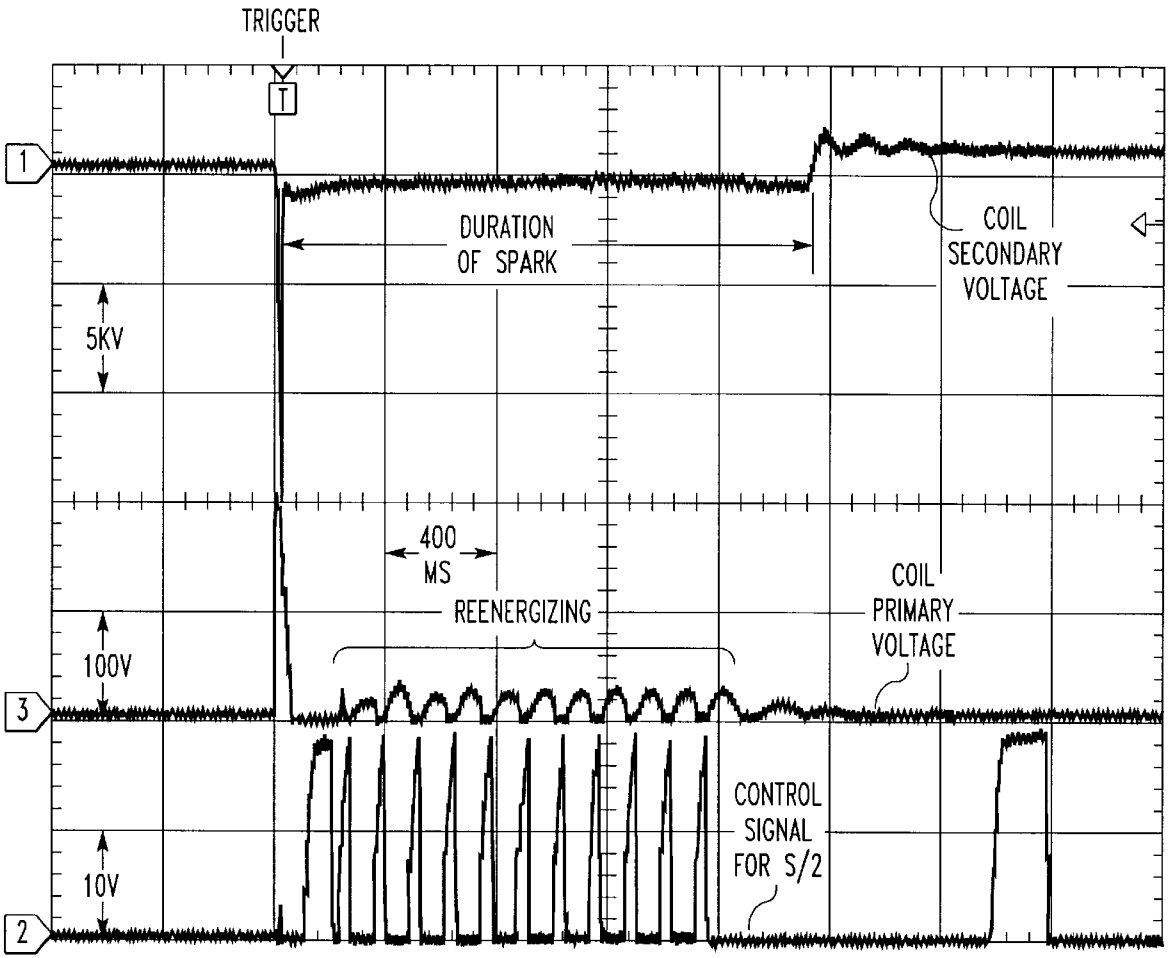
FIG. 5 shows extended capacitive discharge circuit waveforms, according to the present invention, at 19 kV breakdown voltage providing a 1,920 microsecond spark.

FIG. 5 illustrates the operation of a circuit according to the present invention much the same as FIG. 4. However, the spark gap conditions were adjusted to increase the breakdown voltage in the primary of the ignition coil to 19 kV. The duration of the spark, however, remains the same at 1,920 microseconds. Unlike the circuit operating according to the prior art procedures, the spark duration is not tied to the spark gap conditions.

Figure 6:
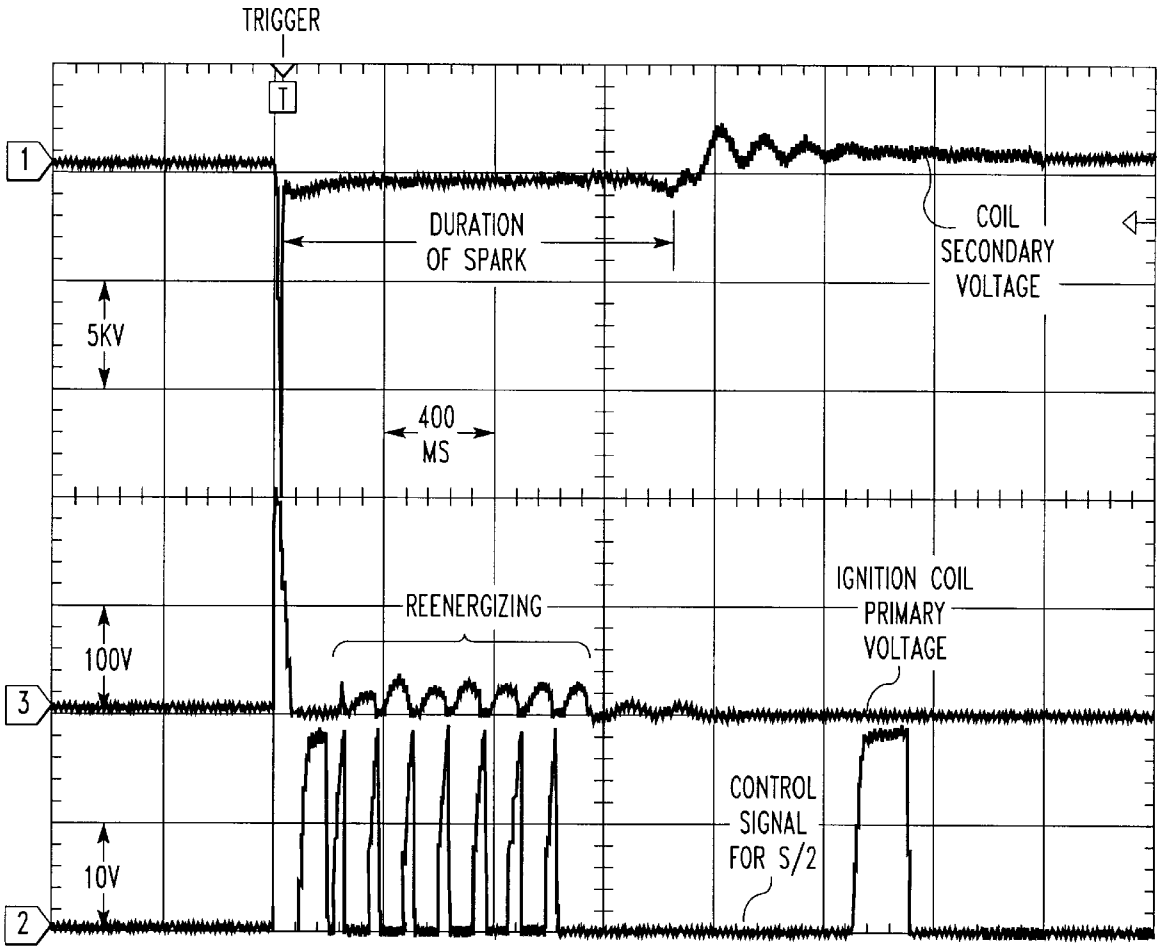
FIG. 6 shows extended capacitive discharge circuit waveforms, according to the present invention, with eight extension pulses.

FIG. 6 illustrates that the spark duration can be controlled by controlling the number of reenergizing pulses supplied to the capacitor C1. In this case, the switch S2 is closed and opened eight (8) times over a period of 1,040 microseconds and the spark duration was extended to 1,440 microseconds.

Figure 7:
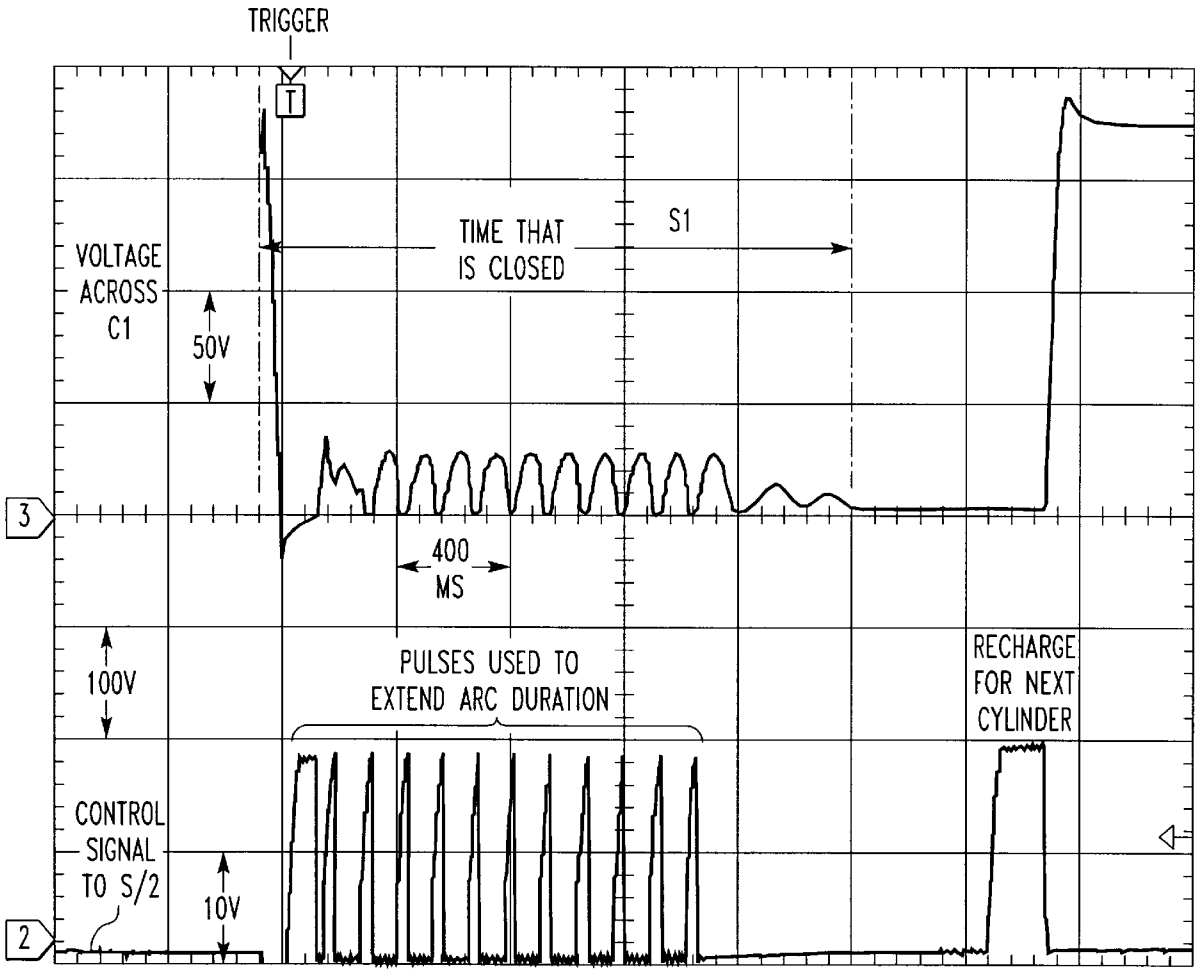
FIG. 7 shows extended capacitive discharge circuit waveforms, according to the present invention, with twelve extension pulses.

FIG. 7 illustrates the voltage across capacitor C1 during operation according to the present invention, wherein after breakdown, the switch S2 is closed and opened twelve (12) times over 1,440 microseconds. Note that the charge on the capacitor C1 is approximately 170 volts prior to close of the switch S1. With each opening and closing, the capacitor is recharged to about 30 volts.

Figure 8:
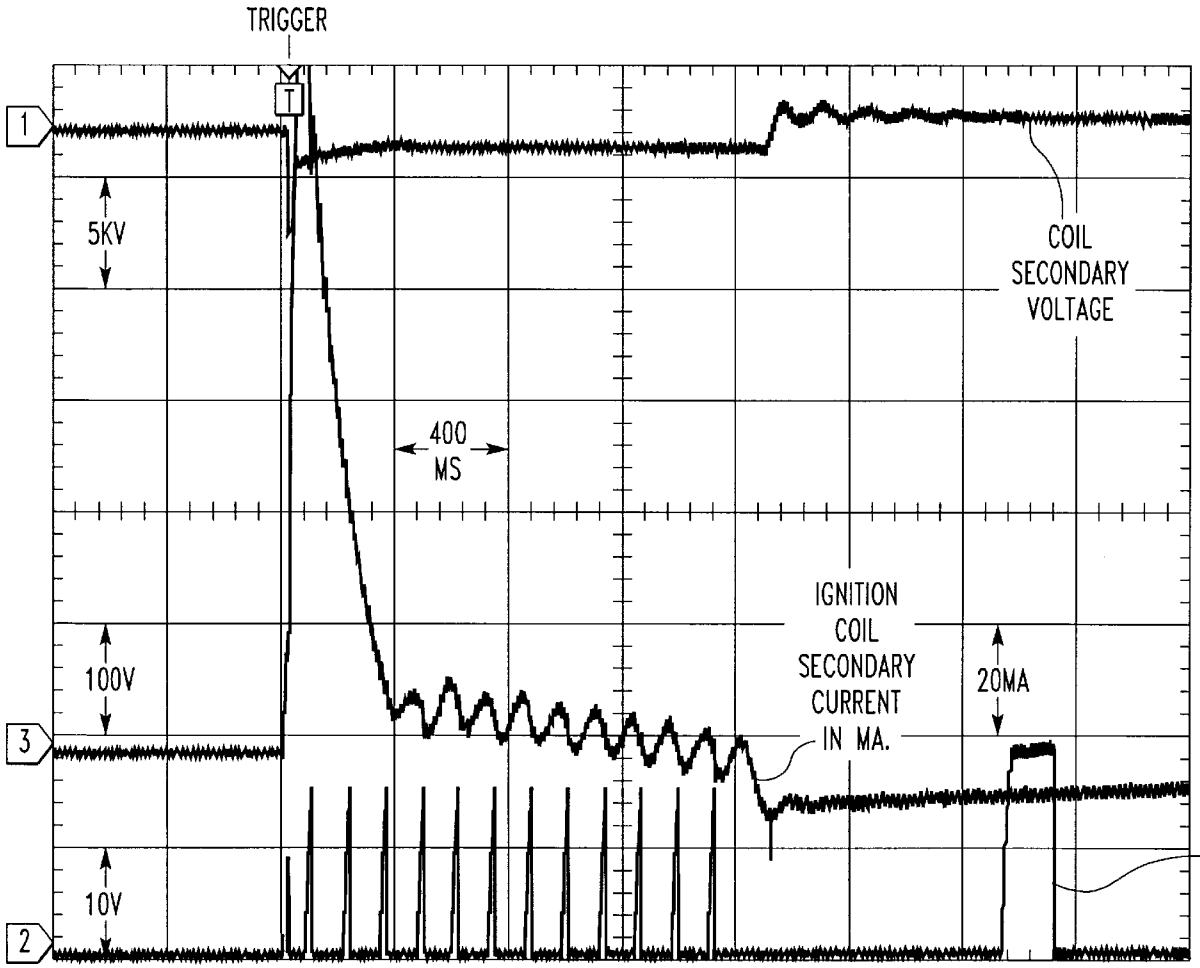
FIG. 8 shows extended capacitive discharge circuit waveforms, according to the present invention, with short duration extension pulses and with low arc current.
Figure 9:
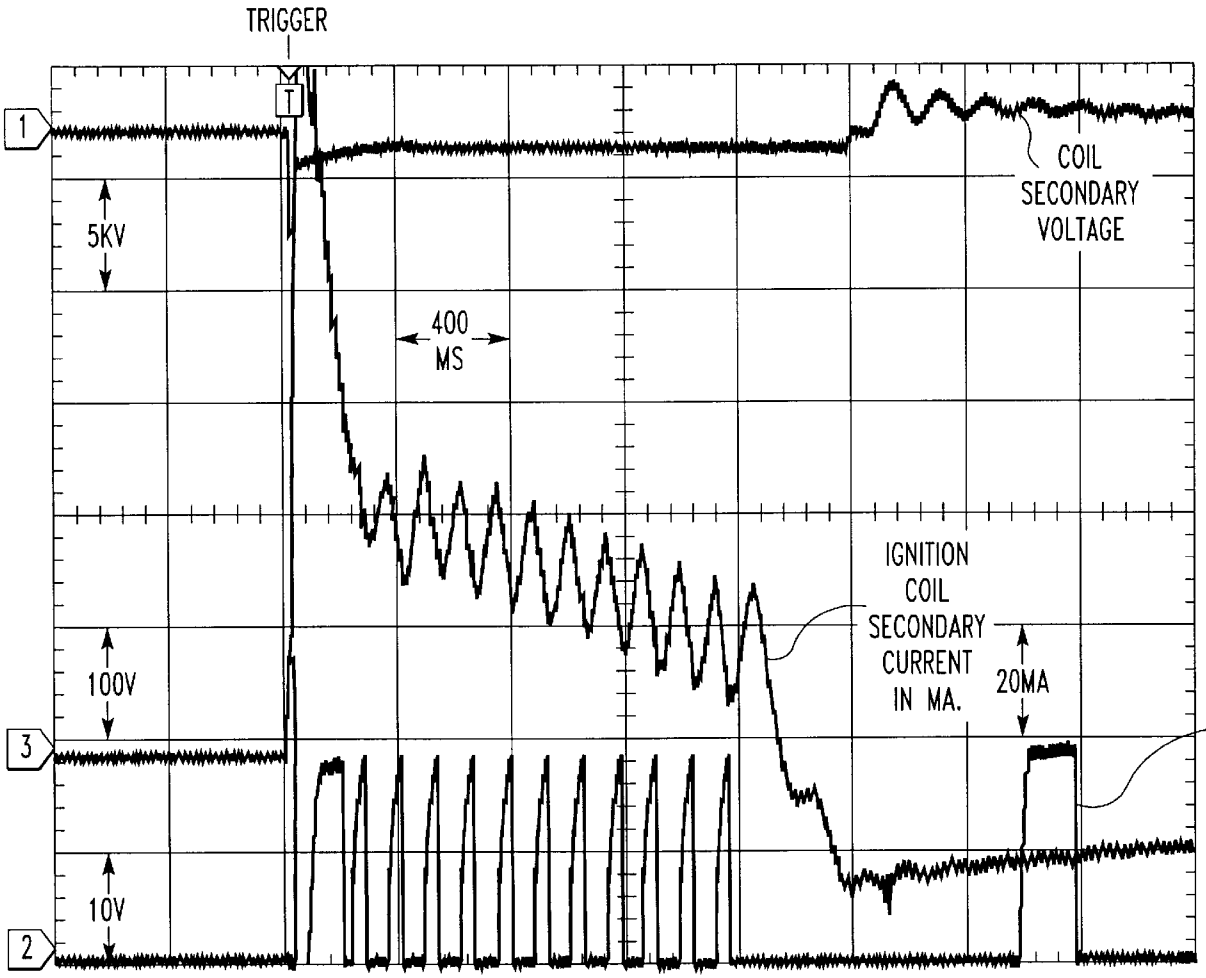
FIG. 9 shows extended capacitive discharge circuit waveforms, according to the present invention, with long duration extension pulses and with higher arc current.

FIGS. 8 and 9 illustrate the current in the ignition secondary (middle trace) as recorded. The difference between the conditions during which FIGS. 8 and 9 were recorded is the width of the time the switch S2 was closed prior to reopening during the recharging period. The middle trace reflects ignition coil secondary current. Due to a serious baseline drift, the trace requires some interpretation. In theory, the current never goes negative. In the test illustrated in both FIGS. 8 and 9, twelve equally spaced reenergizing pulses are used to extend the spark duration. The pulses permitting current to flow in the primary of the converter transformer are wider for the test illustrated in FIG. 9 than in FIG. 8. The current peaks with the narrower energizing pulses are about 8 milliamps whereas with the wider energizing pulse, the current peaks are at about 40 milliamps.

FIGS. 4 and 5 illustrate that with applicant's invention, the spark duration is not dependent on the conditions of the spark gap. FIGS. 6 and 7 illustrate that the duration of the spark may be controlled by controlling the number of reenergizing pulses. FIGS. 8 and 9 illustrate that the current during the extended spark duration can be controlled by controlling the width of the reenergizing pulses.

Having thus described my invention in the detail and particularity required by the Patent Laws, what is desired protected by Letters Patent is set forth in the following claims.

The invention claimed is:

1. A capacitive discharge ignition system for an internal combustion engine comprising:

a storage capacitor and diode in series therewith;

a converter transformer having primary and secondary windings, the secondary winding thereof connected in series with the storage capacitor and diode;

an ignition transformer having primary and secondary windings;

a first triggerable switch(S1) the primary winding of the ignition transformer and the storage capacitor being connected in series through the triggerable switch; a spark plug connected in series with the secondary winding of the ignition transformer; a source of direct current and a second triggerable switch(S2) connected in series with the primary of the converter transformer; and control circuit for the first and second triggerable switches operating in synchronism with the engine such that while the first switch is opened, the second switch is closed for a period of time to store energy in the converter transformer and then opened to transfer that energy to the storage capacitor followed by the closing of the first switch to discharge the storage capacitor into the primary of the ignition transformer and while the first switch remains closed, the second switch is again closed and then opened to transfer the energy stored in the converter transformer to the ignition transformer primary to prolong the current flow in the secondary winding of the ignition transformer.

2. A device according to claim 1, wherein the control circuit for the triggerable switches enables the second switch to be opened and closed a variable number of times while the first switch remains closed during each firing event to control the arc duration of the spark.

3. A device according to claim 1, wherein the control circuit for the triggerable switches enables the time period for which the second switch remains closed before each iteration of it then being opened while the first switch remains closed to be a variable (T) used to control the amplitude of the extended arc current of the spark.

4. A device according to claim 1, 2, or 3, wherein the control circuit for the triggerable switches enables the duration and amplitude of the extended arc current of the spark to be controlled independently of the initial breakdown voltage required to initiate the spark.

5. A device according to claim 1, wherein the control circuit for the triggerable switches enables the second triggerable switch is to be closed and opened at spaced intervals and the ratio of closed time to open time to be controlled to control the current during the prolonged spark.

* * * * *

UNITED STATES PATENT AND TRADEMARK OFFICE

CERTIFICATE OF CORRECTION

PATENT NO. : 6,701,904 B2
DATED : March 9, 2004
INVENTOR(S) : Joseph M. Lepley

It is certified that error appears in the above-identified patent and that said Letters Patent is hereby corrected as shown below:

Column 4,
Line 53, "(S1)" should read -- (S1), --.

Column 6,
Line 11, "is to be" should read -- to be --.

Signed and Sealed this

Twenty-seventh Day of July, 2004

JON W. DUDAS
*Acting Director of the United States Patent and Trademark Office*